US007264529B2

(12) United States Patent
Wada et al.

(10) Patent No.: US 7,264,529 B2
(45) Date of Patent: Sep. 4, 2007

(54) METHOD OF MANUFACTURING AN IMAGE DISPLAY DEVICE HAVING A SEALING PORTION WHICH SEALS PERIPHERAL EDGES OF FRONT AND BACK SUBSTRATES

(75) Inventors: Hiroyuki Wada, Tokyo (JP); Akiyoshi Yamada, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/538,569

(22) Filed: Oct. 4, 2006

(65) Prior Publication Data

US 2007/0087545 A1 Apr. 19, 2007

Related U.S. Application Data

(63) Continuation of application No. PCT/JP2005/007726, filed on Apr. 22, 2005.

(30) Foreign Application Priority Data

May 11, 2004 (JP) ..... 2004-141130

(51) Int. Cl.
*H01J 9/00* (2006.01)

(52) U.S. Cl. ..... 445/25

(58) Field of Classification Search ..... 445/23–25
See application file for complete search history.

(56) References Cited

FOREIGN PATENT DOCUMENTS

| | | |
|---|---|---|
| JP | 2000-251767 A | 9/2000 |
| JP | 2001-229825 | 8/2001 |
| JP | 2002-184328 A | 6/2002 |
| JP | 2002-319346 | 10/2002 |
| JP | 2003-123673 A | 4/2003 |

*Primary Examiner*—Joseph Williams
(74) *Attorney, Agent, or Firm*—Oblon, Spivak, McClelland, Maier & Neustadt, P.C.

(57) ABSTRACT

The present application relates to a method of manufacturing an image display device. The manufacturing method includes a step of arranging a side wall made of metal extending along an inner peripheral edge of a front substrate or a back substrate on the inner peripheral edge in a state that the side wall is spaced from a sealing layer, a step of melting or softening the sealing layer by heating the sealing layer and the side wall, and at the same time, discharging gas from the from the side wall, and a step of pressing the side wall against the sealing layer to be bonded thereto by moving the front substrate and the back substrate in a direction such that the substrates are close to each other.

3 Claims, 6 Drawing Sheets

METHOD OF MANUFACTURING AN IMAGE DISPLAY DEVICE HAVING A SEALING PORTION WHICH SEALS PERIPHERAL EDGES OF FRONT AND BACK SUBSTRATES

CROSS-REFERENCE TO RELATED APPLICATIONS

This is a Continuation Application of PCT Application No. PCT/JP2005/007726, filed Apr. 22, 2005, which was published under PCT Article 21(2) in Japanese.

This application is based upon and claims the benefit of priority from prior Japanese Patent Application No. 2004-141130, filed May 11, 2004, the entire contents of which are incorporated herein by reference.

BACKGROUND OF THE INVENTION

1. Field of the Invention

The present invention relates to a method of manufacturing an image display device of a flat shape, which has oppositely arranged substrates.

2. Description of the Related Art

Recently, various types of image display devices have been developed as the next generation image display device, light in weight and flat in shape, which will supersede a cathode ray tube (referred to as a CRT). Examples of those image display devices are a liquid crystal display (referred to as an LCD) which controls light intensities by utilizing alignment of a liquid crystal, a plasma display panel (referred to as a PDP) in which ultraviolet rays in plasma discharge energize a fluorescent material to emit light, a field emission display (referred to as an FED) in which an electron beam emitted from a field emission type electron emission element energizes a fluorescent material to emit light, and a surface-conduction electron emitter display (referred to as an SED), as a kind of FED, which uses a surface-conduction electron emission element.

Generally, the FED includes a front substrate and a back substrate which are oppositely arranged while being spaced from each other by a predetermined gap. Those substrates are bonded together at the peripheral portions in a state that a rectangular frame-like side wall is interposed therebetween, thereby forming a vacuum envelope. A fluorescent screen is formed on the inner surface of the front substrate. A number of electron emission elements as electron emission sources for exciting the fluorescent material to emit light are provided on the inner surface of the back substrate.

A plurality of support members are arranged between the back substrate and the front substrate in order to support the atmospheric load applied to those substrates. A potential of the back substrate is substantially equal to an earth potential, and an anode voltage is applied to the fluorescent surface. An image is displayed in such a manner that red, green and blue fluorescent materials constituting the fluorescent screen are irradiated with electron beams emitted from a number of electron emission elements, thereby to light.

Those types of display devices may be reduced in thickness to about several millimeters. The size and thickness reduction could be achieved as compared to the CRT, currently used for televisions and computers.

In the case of the FED, it is necessary to evacuate the inside of the envelope. Also in the case of the PDP, the envelope is evacuated and then filled with discharge gas. In Jpn. Pat. Appln. KOKAI Publication No. 2001-229825, there is a proposal of means for evacuating an envelope. In the proposal, the final step of assembling a front substrate and a back substrate, which constitute the envelope, is carried out in a vacuum vessel.

In this method, the front and back substrates, which are placed in the vacuum vessel, are sufficiently heated. This is done to suppress the discharging of gas through the inner wall of the envelope, which is a major cause of degrading the degree of vacuum in the envelope.

When the front and back substrates are cooled and the degree of vacuum in the vacuum vessel is satisfactorily increased, a getter film to improve the degree of vacuum in the envelope and maintain the improved one is formed on a fluorescent screen. Following this, the front and back substrates are heated again up to a temperature at which a sealing material melts. The front and back substrates are cooled in a state that those are assembled at a predetermined position until the sealing material is solidified.

In the vacuum envelope manufactured by such a method, the sealing step and the vacuum sealing step are carried out at one time, there is no need of spending such a time taken as in the case of exhausting the envelope, and an extremely satisfactory degree of vacuum can be obtained.

A side wall of the envelope is formed with a glass frame as disclosed in Jpn. Pat. Appln. KOKAI Publication No. 2002-319346. The glass frame, when it is relatively small, is manufactured by directly press-molding molten glass or directly cutting it out of a thin sheet glass of large size.

BRIEF SUMMARY OF THE INVENTION

The method mentioned above uses expensive glass. For this reason, in the case of a large glass frame, cost of manufacture is high, high technical skill is required, and manufacturing efficiency is decreased.

Accordingly, the present invention has been made in the light of the above circumstances, and an object of the present invention is to provide a method of manufacturing an image display device which can be manufactured at low cost and easily.

According to one aspect of the present invention, there is provided a method of manufacturing an image display device comprising an envelope having a front substrate and a back substrate, which are oppositely arranged and have image displaying pixels, and a sealing portion which seals peripheral edges of the front substrate and the back substrate, the method comprising: forming a sealing layer entirely on and along at least one of an inner peripheral edge of the front substrate and an inner peripheral edge of the back substrate; arranging a frame body of metal extending along an inner peripheral portion of the front substrate or the back substrate on the inner peripheral edge in a state that the frame body is spaced from the sealing layer; after the frame body is arranged, arranging the front substrate and the back substrate in a state that the substrates are confronted with each other; after the substrates are arranged, heating the sealing layer and the frame body to melt or soften the sealing layer, and at the same time, discharging gas from the frame body; and after the gas is discharged, moving the front substrate and the back substrate in a direction that the substrates are close to each other, thereby to press the frame body against the sealing material layer to be bonded thereto and to seal the peripheral edges of the front substrate and the back substrate.

DETAILED DESCRIPTION OF THE INVENTION

Embodiments of the present invention in which a display device according to the present invention is applied to an FED with reference to the accompanying drawings.

Figure 1:
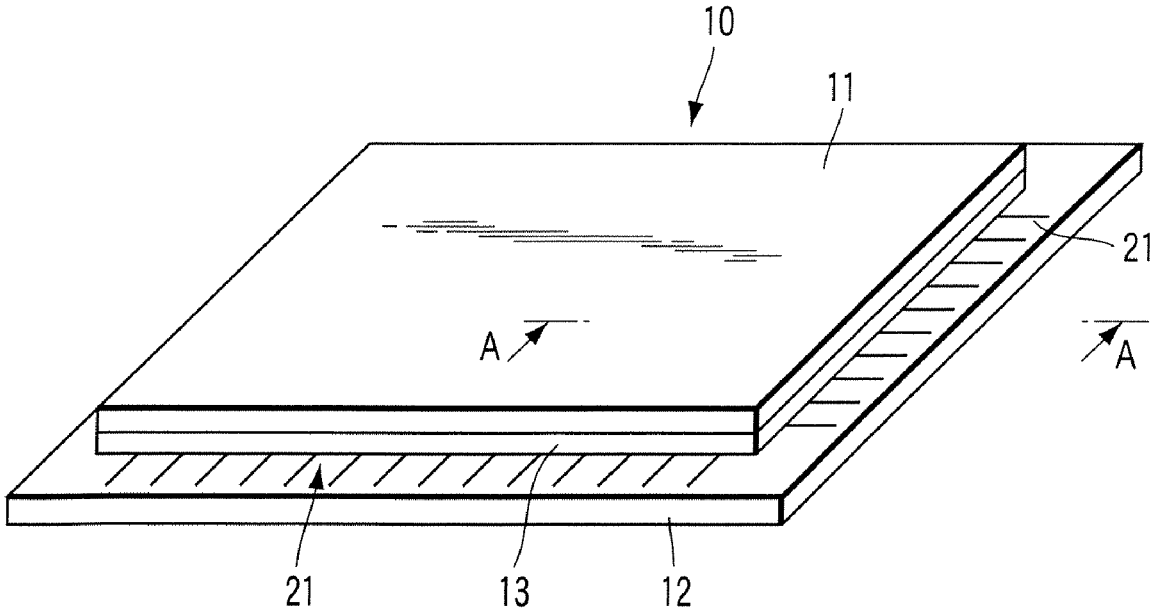
FIG. 1 is a perspective view showing an FED according to an embodiment of the present invention.
Figure 2:
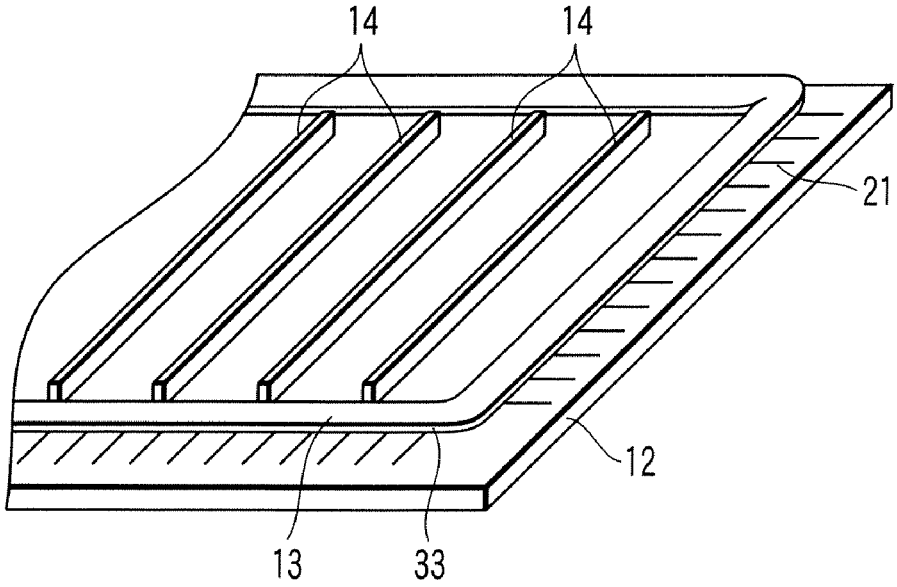
FIG. 2 is a perspective view showing the FED when its front substrate is removed.
Figure 3:
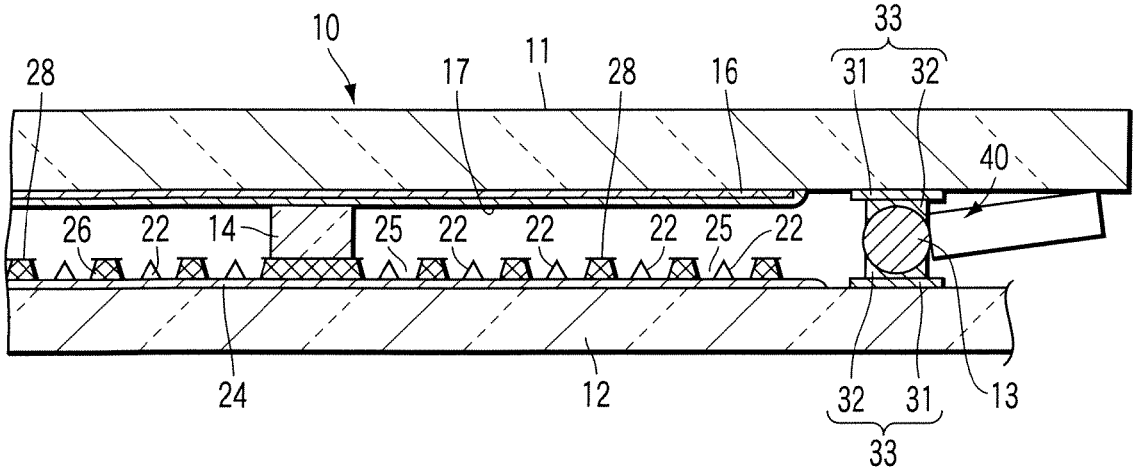
FIG. 3 is a cross-sectional view taken along line A-A in FIG. 1.

As shown in FIGS. 1 to 3, the FED includes insulating substrates of a front substrate 11 and a back substrate 12, which are formed with rectangular glass plates. Those substrates are oppositely arranged with a gap of 1 to 2 mm formed therebetween. The front substrate 11 and the back substrate 12 are bonded together along the peripheral portion in a state that a rectangular frame-like side wall 13 is interposed therebetween, to thereby constitute a flat, rectangular vacuum envelope 10 the inside of which is kept in a vacuum state.

The peripheral portions of the front substrate 11 and the back substrate 12 are bonded together by a sealing portion 40. More specifically, the side wall 13 functioning as a frame body is arranged between a sealing face located on an inner peripheral edge of the front substrate 11 and a sealing face on an inner peripheral edge of the back substrate 12. A gap between the front substrate 11 and the side wall 13 and that between the back substrate 12 and the side wall 13 are respectively sealed with sealing layers 33 into which base layers 31 formed on the sealing faces of the substrates and indium layers 32 formed on the base layers 31 are molten. The sealing layers 33 and the side wall 13 constitute the sealing portion 40.

In the present embodiment, a cross section of the side wall 13 is circular.

A plurality of plate-like support members 14 are provided in the vacuum envelope 10 in order to support the atmospheric pressure load applied to the back substrate 12 and the front substrate 11. Those support members 14 extend parallel to the short sides of the vacuum envelope 10, and are arrayed at a constant interval in a direction parallel to the long sides of the vacuum envelope. The configuration of each support member 14 is not limited to a specific one, but it may be a column.

Figure 4:
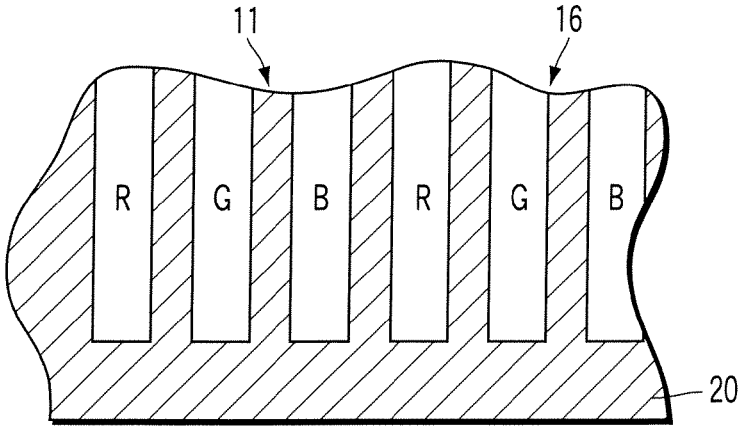
FIG. 4 is a plan view showing a fluorescent screen of the FED.

As shown in FIG. 4, a fluorescent screen 16 is formed on the inner surface of the front substrate 11. Stripe-shaped fluorescent layers R, G and B for emitting three color lights of red, blue and green, and stripe-shaped black light absorption layers 20 serving as non-light emission units, which are each located between the adjacent fluorescent layers, are arrayed side by side on the fluorescent screen 16. The fluorescent layers R, G and B extend parallel to the short sides of the vacuum envelope 10, and are arrayed at constant intervals in a direction parallel to the long sides of the vacuum envelope 10. A metal back 17 made of aluminum is vapor deposited on the fluorescent screen 16, and a getter film (not shown) is formed on the metal back.

A number of field emission type electron emission elements 22, as electron emission sources, for exciting the fluorescent layers R, G and B are provided on the inner surface of the back substrate 12. The electron emission elements 22 are arrayed in a plurality of rows and in a plurality of columns, which correspond in position to pixels. A number of wires 21 for supplying drive signals to the electron emission elements 22 are formed in a matrix on the inner surface of the back substrate 12. The ends of the wires are led out to the peripheral edges of the back substrate.

A method of manufacturing the FED thus configured will now be described in detail.

Figure 5:
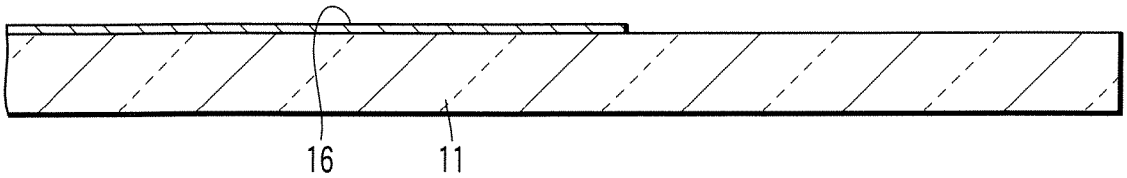
FIG. 5 is a cross-sectional view showing a stage of an FED manufacturing process where a screen is formed on the front substrate.

First, as shown in FIG. 5, a fluorescent screen 16 is formed on a sheet glass to be a front substrate 11. To be exact, a sheet glass being equal in size to the front substrate 11 is prepared, and a stripe pattern of a fluorescent layer is formed on the sheet glass by a plotter machine. The sheet glass having the fluorescent stripe pattern formed thereon and a sheet glass for the front substrate are placed on a positioning jig to be set on an exposure table, and are subjected to exposure and developing processes to thereby form the fluorescent screen 16.

Figure 6:
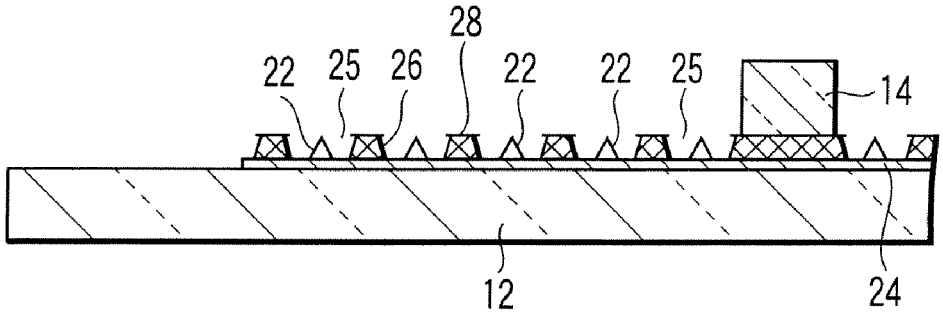
FIG. 6 is a cross-sectional view showing another stage of the FED manufacturing process where electron emission elements and the like are formed on a back substrate.

Subsequently, as shown in FIG. 6, electron emission elements 22 are formed on a sheet glass for the back substrate. In this case, conductive cathode layers shaped in a matrix are formed on the sheet glass, and silicon dioxide films as insulating films are formed on the conductive cathode layers by, for example, a thermal oxidation method, a CVD method or a sputtering method. Thereafter, metal films for gate electrode formation, made of molybdenum or niobium, are formed on the insulating films by, for example, a sputtering method or an electron beam vapor deposition method. Then, a resist pattern corresponding in shape to gate electrodes to be formed are formed on the metal films by lithography process. The metal films are etched away by wet or dry etching process, by using the resist pattern as a mask, thereby forming gate electrodes 28.

A high voltage is applied to the fluorescent screen 16. For this reason, the sheet glasses for the front substrate 11, the back substrate 12 and the support members 14 are made of high-strain-point glass.

Subsequently, the insulating films are etched away by wet or dry etching process to form cavities 25, by using the resist pattern and the gate electrodes as masks. After removal of the resist pattern, electron beam vapor-deposition process is applied to the surface of the back substrate at a predetermined angle to thereby form peeling layers made of, for example, aluminum or nickel on the gate electrodes 28. Then, a cathode forming material, for example, molybdenum, is applied to the surface of the back substrate in a vertical direction, to thereby vapor deposit the surface thereof by a electron beam vapor-deposition process. In this way, electron emission elements 22 are formed in the cavities 25. Following this, the peeling layers, together with the metal films formed thereon, are removed by a lift-off process.

Figure 7:
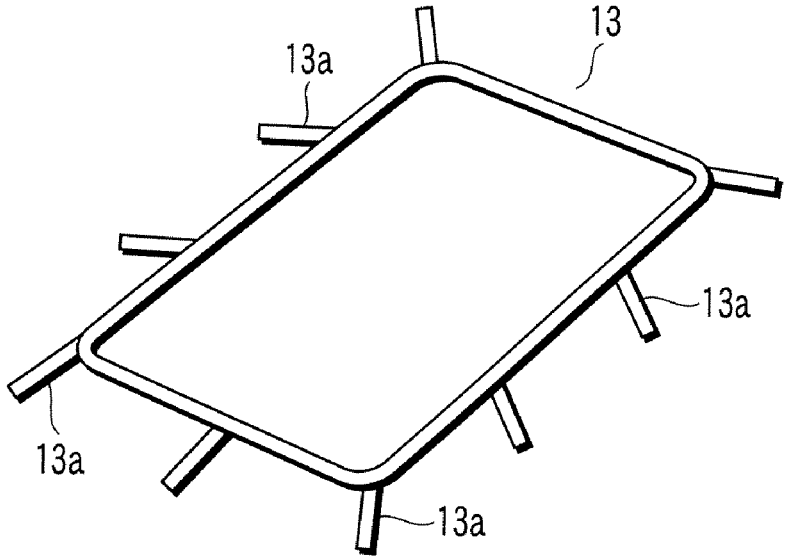
FIG. 7 is a perspective view showing still another stage of the FED manufacturing process where a side wall is formed.

Subsequently, as shown in FIG. 7, a side wall 13 is formed, which serves as a metal frame body to be located along the peripheral edges of the substrates. The side wall 13 is formed with a metal cylindrical rod or a wire, which is circular in cross section. More specifically, the side wall 13 is constituted in such a manner that it is bent at three positions according to a required size to be rectangular, and both ends thereof are welded by a laser welding machine. The welding operation is instantaneously performed only at the welding points by the laser welding machine.

The metal used for the side wall 13 is a conductive metal or an alloy containing at least one of Fe, Ni and Ti, or a nonconductive metal, such as glass or ceramic. In this instance, an Ni alloy or the like is used.

A plurality of elastic protrusions 13*a* made of metal are upwardly protruded from the periphery of the side wall 13, while being arrayed at a constant interval along the periphery of the side wall. The protrusions 13*a* are slanted obliquely and downwardly, and integrally joined to the side wall 13 by welding, for example.

Figure 8:
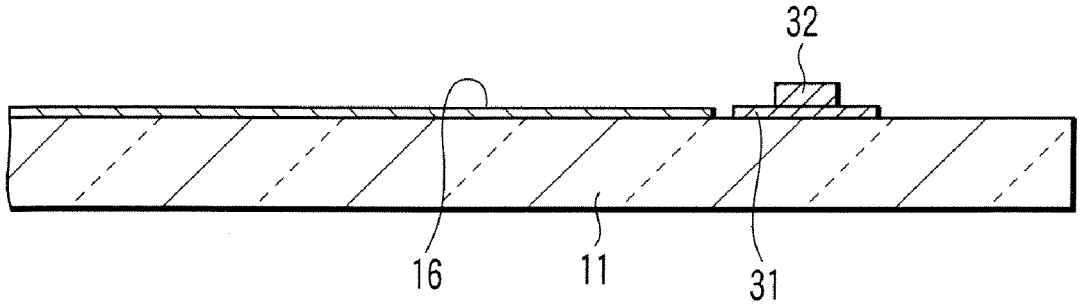
FIG. 8 is a cross-sectional view showing a further stage of the FED manufacturing process where a base layer and an indium layer are formed on the front substrate.
Figure 9:
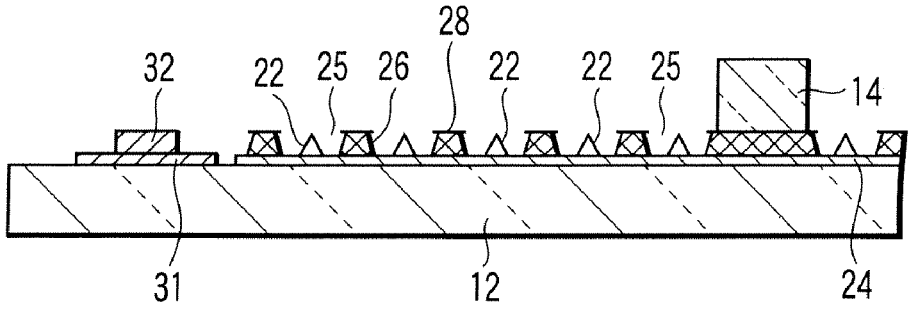
FIG. 9 is a cross-sectional view showing a further stage of the FED manufacturing process where a base layer and an indium layer are formed on the back substrate.

Then, as shown in FIGS. 8 and 9, a sealing face on the inner peripheral edge of the front substrate 11 and a sealing face on an inner peripheral edge of the back substrate 12 are coated with silver paste by a screen printing method, thereby forming frame-like base layers 31. Subsequently, each base layer 31 is coated with indium as a metal sealing material being conductive, thereby to form an indium layer 32 extending along the entire periphery of the base layer.

The metal sealing material is preferably a metal material which is low in melting point, not higher than about 350° C., and excellent in adhesiveness and bonding property. Indium (In) for use in the embodiment not only has a low melting point, 156.7° C., but has excellent features: its vapor pressure is low, it is soft and durable for impact, and it is not fragile even at low temperature. Further, it may be bonded directly to glass under appropriate conditions. In this respect, indium is one of the materials suitable for the present invention.

Figure 10:
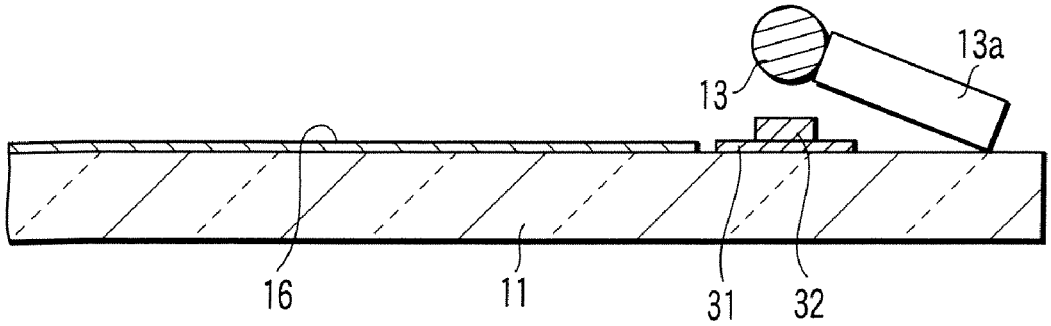
FIG. 10 is a cross-sectional view showing an additional stage of the FED manufacturing process where a side wall is formed on the front substrate.

Subsequently, as shown in FIG. 10, the side wall 13 is put on the front substrate 11. At this time, the end of the protrusion 13*a* of the side wall 13 is brought into contact with the front substrate 11 at a position off the base layer 31 and the indium layer 32. As a consequence, the side wall 13 is supported on the front substrate 11 in a state that it is located above the indium layer 32 with the aid of the protrusion 13*a*.

Figure 11:
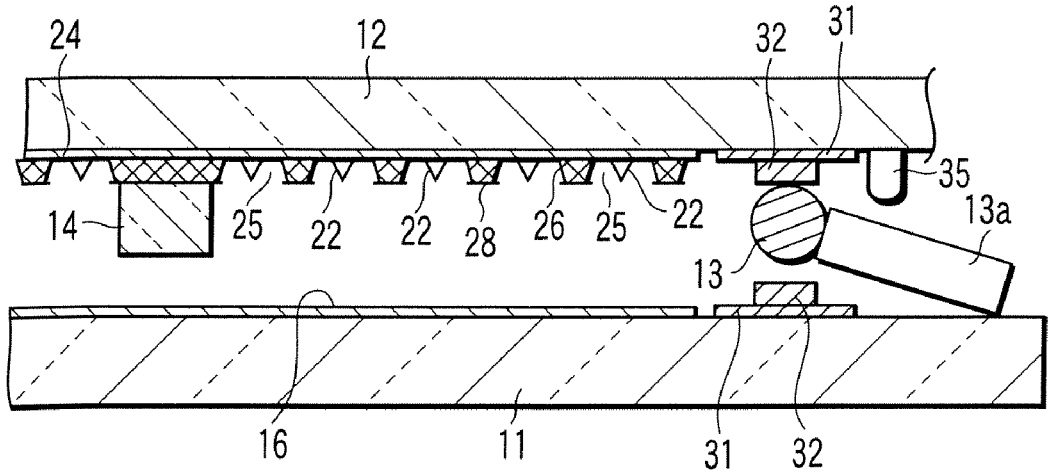
FIG. 11 is a cross-sectional view showing an additional stage of the FED manufacturing process where the back substrate is opposed to the front substrate.

Then, as shown in FIG. 11, the back substrate 12 having the base layers 31 and the indium layers 32, which are formed on the sealing face thereof, and the front substrate 11 having the side wall 13 put thereon are opposed to each other in a state that the sealing faces thereof face each other with a predetermined space being interposed therebetween, and those substrates are held by a jig or the like. At this time, the front substrate 11, faced upward, is arranged under the back substrate 12. In this state, the front substrate 11 and the back substrate 12 are put into a vacuum treatment apparatus.

Figure 12:
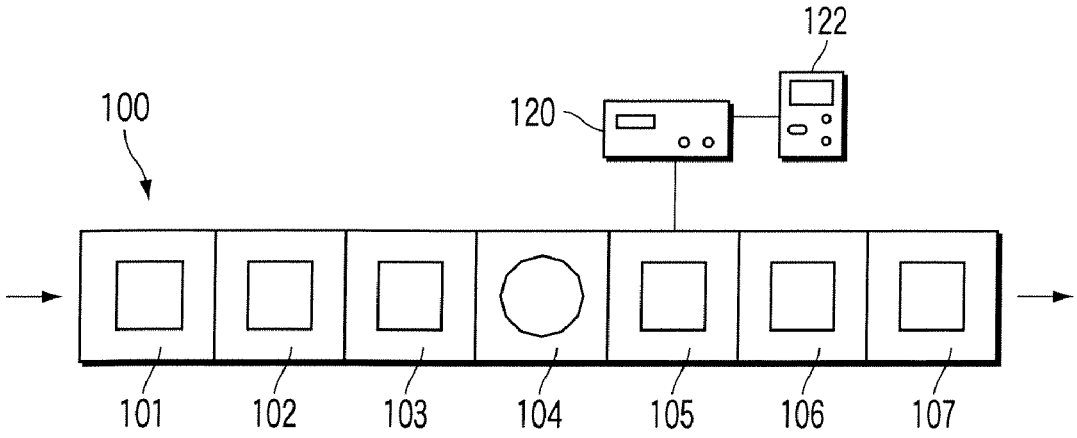
FIG. 12 is a view schematically showing a vacuum treatment apparatus for use in manufacture of the FED.

The vacuum treatment apparatus 100, as shown in FIG. 12, includes a loading chamber 101, a baking/electron beam cleaning chamber 102, a cooling chamber 103, a getter film vapor depositing chamber 104, an assembling chamber 105, a cooling envelope 106, and an unloading chamber 107, the chambers being arranged side by side. These chambers are constituted as treatment chambers capable of performing vacuum treatments, and are all evacuated when the FED is manufactured. The adjacent treatment chambers are connected to each other by means of gate valves and the like.

The front substrate 11 and the back substrate 12, which have the side wall 13 put therebetween, are put into the loading chamber 101, the loading chamber 101 is vacuumed, and then the substrates are transferred to the baking/electron beam cleaning chamber 102. In the baking/electron beam cleaning chamber 102, at a time point where a high degree of vacuum of about 10 to 5 Pa is reached, the front and back substrates are heated to about 300° C. and baked, to thereby discharge surface absorbed gas from the members. It is to be noted that the side wall 13 is separated from the indium layers 32 as shown in FIG. 11. Accordingly, the surface absorbed gas is well discharged, and hence, there is no chance that the surface absorbed gas is confined and left in a space between it and the indium layers 32.

At 300° C., the indium layers (melting point: 156° C.) 32 are molten. However, the indium layers 32 are respectively formed on the base layers 31 each having a high affinity to the indium layer, and therefore, the indium never flows and is held on the base layers 31.

In the baking/electron beam cleaning chamber 102, concurrently with the heating process, an electron beam generator (not shown) mounted on the baking/electron beam cleaning chamber 102 emits an electron beam to the fluorescent screen of the front-substrate side assembly and the electron emission element surface of the back substrate 12. Since the electron beam is deflected by a deflecting device mounted on the outside of the electron beam generator, the fluorescent screen surface and the electron emission element surface are entirely cleaned by the electron beam.

Following the heating process and the electron beam cleaning, the front substrate 11 and the back substrate 12 are transferred to the cooling chamber 103 where the substrates are cooled to about 100° C. Subsequently, the front substrate 11 and the back substrate 12 are transferred to the getter film vapor depositing chamber 104 where Ba films are vapor deposited as getter films on the fluorescent screen and the metal back. The Ba film surfaces are prevented from being contaminated with oxygen and carbon, and hence, their activity can be maintained.

Figure 13:
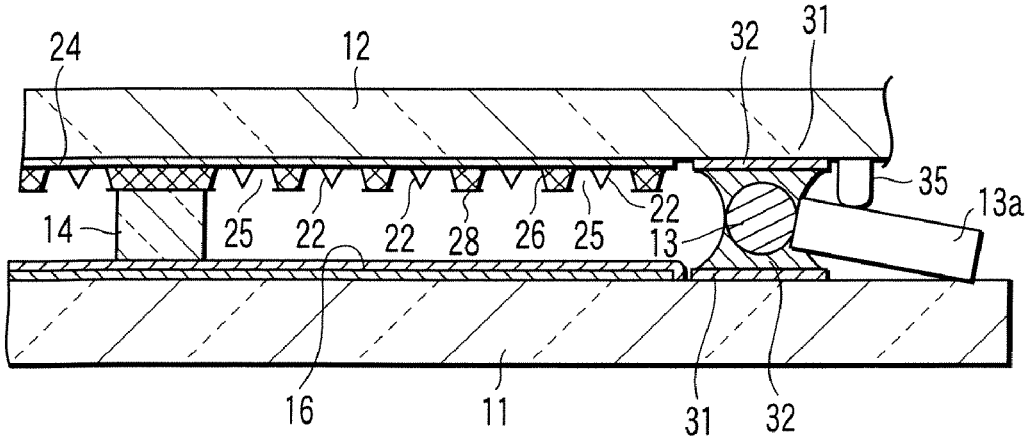
FIG. 13 is a cross-sectional view showing an additional stage of the FED manufacturing process where the side wall is bonded to the front substrate and the back substrate.

The front substrate 11 and the back substrate 12 are transferred to the assembling chamber 105 where the substrates are heated to 200° C. As a result, the indium layers 32 are molten or softened again. In this state, as shown in FIG. 13, the back substrate 12 is moved to the front substrate 11. Consequently, the protrusions 13*a* of the side wall 13 are pressed with a pressing body 35, which moves with the movement of the back substrate 12. By the pressing, the side wall 13 is pressed downward, an its lower surface is pressed against the indium layer 32 of the front substrate 11, while the indium layer 32 of the back substrate 12 is pressed against the upper surface of the side wall.

Following this, the indium layers 32 are gradually cooled to be solidified. As a result, the back substrate 12 and the side wall 13 are sealed with the sealing layer 33 into which the indium layers 32 and the base layers 31 are molten. At the same time, the front substrate 11 and the side wall 13 are sealed with the sealing layer 33 into which the indium layers 32 and the base layers 31 are molten, whereby a vacuum envelope 10 is formed.

The vacuum envelope 10 thus formed is cooled to room temperature in the cooling chamber 106, and thereafter, it is taken out from the unloading chamber 107. In this way, an FED is completed.

As described above, according to the present embodiment, the side wall 13 is constituted by the metal frame body. This feature brings about many advantages: the material cost and hence, the cost of manufacture are reduced, the number of process steps is reduced, and the manufacturing efficiency is improved.

When the front and back substrates are baked by heating them to about 300° C. to discharge the surface absorbed gas of the respective members, the side wall 13 is held in a state that it is spaced from the indium layers 32. With this feature, there is no possibility that the surface absorbed gas is confined and left in a space between it and the indium layers 32, and hence, the side wall 13 is well bonded to the indium layers 32.

Figure 14:
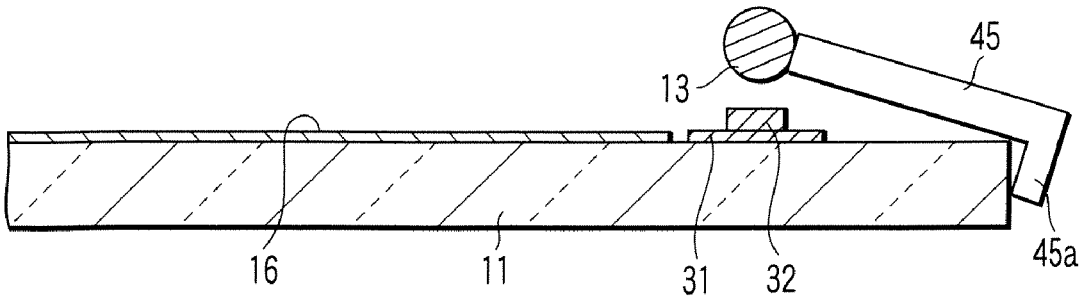
FIG. 14 is a view showing another protrusion of the side wall.

FIG. 14 shows another protrusion of the side wall 13.

In this protrusion 45, a positioning bent portion 45*a* is formed at the end of the protrusion, which is located opposite to the side wall 13.

When the side wall 13 is placed on the front substrate 11, it is positioned by engaging the bent portion 45*a* with the side surface of the front substrate 11. According to this example, it is easy to position the side wall 13 to the front substrate 11.

Figure 15:
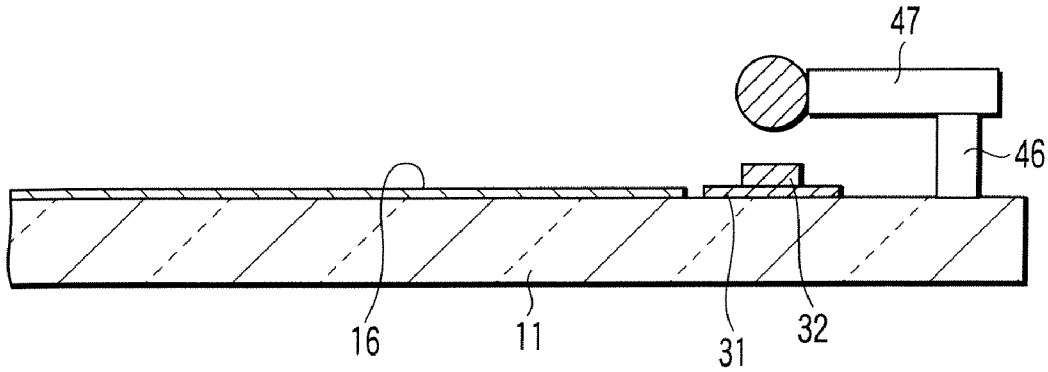
FIG. 15 is a view showing still another protrusion of the side wall.

FIG. 15 shows still another protrusion of the side wall.

This protrusion 47 is protruded horizontally, not slanted to the side wall 13. A support member 46 is vertically provided at the end of the protrusion 47, which is opposite to the side wall. The support member 46 is made of a material, which is molten in the baking process, (e.g., Bi, In, Sn, and Ag alloy). The side wall 13 is supported on the front substrate 11 with the aid of the protrusion 47 and the support member 46, in a state that it is spaced from the indium layers 32.

Figure 16:
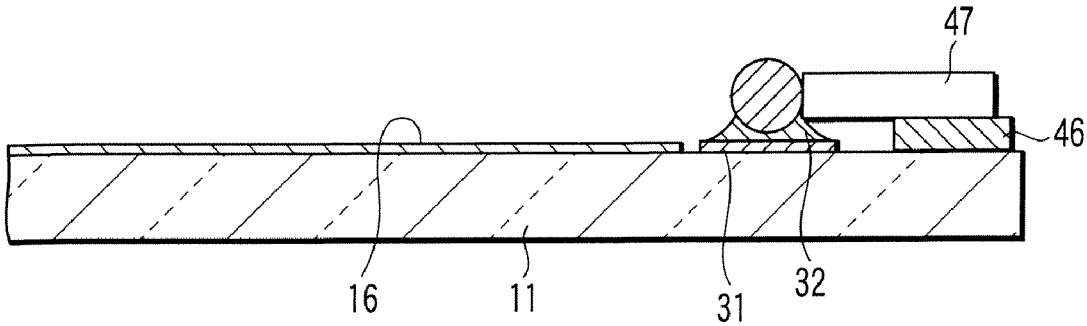
FIG. 16 is a view showing a stage of the FED manufacturing process where the side wall of FIG. 15 is bonded.

In this example, when heated in the baking process, the support member 46 melts and the side wall 13 drops by gravity and comes into contact with the indium layer 32 to be bonded thereto, as shown in FIG. 16.

Figure 17:
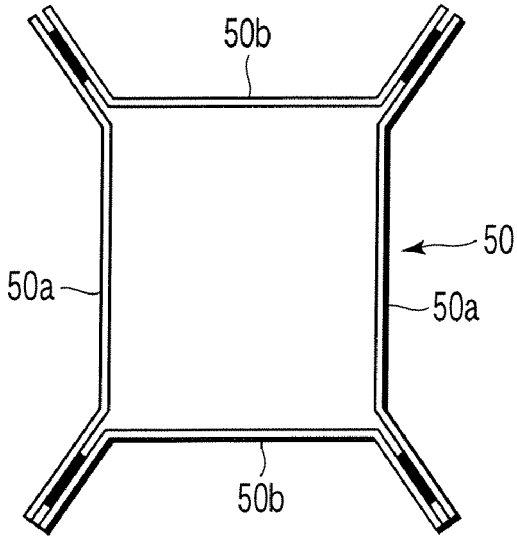
FIG. 17 is a plan view showing a side wall which is another embodiment of the invention.

FIG. 17 shows another embodiment of a side wall and a protrusion.

In this embodiment, a side wall 50 is formed with four metal bars 50*a* to 50*d*. Protrusions 51*a* to 51*d* are formed by bending and overlapping both ends of the four metal rods 50*a* to 50*d*, and joining the overlapped portions by thermal fusion.

In the embodiment mentioned above, the protrusions 13*a* of the side wall 13 are pressed down by the pressing body 35 which moves with the movement of the back substrate 12 to thereby press the side wall 13 against the indium layers 32. Alternatively, the pressing body 35 is moved by a drive mechanism separately provided to thereby press the side wall 13 against the indium layers 32.

It is a matter of course that the present invention may be modified, altered and changed within the scope of the invention.

In the present invention, the side wall is formed with the metal frame body. Therefore, the material cost and hence the cost to manufacture are reduced, the number of process steps is reduced, and the manufacturing efficiency is improved.

The frame body is heated in a state that it is separated from the sealing layers, and pressed against the sealing layers. Therefore, after the surface absorbed gas of the frame body is sufficiently discharged, the frame body is pressed against the sealing layers. As a consequence, good bonding can be achieved free from the possibility that the surface absorbed gas is confined and left in a space between it and the indium layers 32.

What is claimed is:

1. A method of manufacturing an image display device comprising an envelope having a front substrate and a back substrate, which are oppositely arranged and have image displaying pixels, and a sealing portion which seals peripheral edges of the front substrate and the back substrate, the method comprising:

forming a sealing layer entirely on and along at least one of an inner peripheral edge of the front substrate and an inner peripheral edge of the back substrate;

arranging a frame body of metal extending along an inner peripheral portion of the front substrate or the back substrate on the inner peripheral edge in a state that the frame body is spaced from the sealing layer;

after the frame body is arranged, arranging the front substrate and the back substrate in a state that the substrates are confronted with each other;

after the substrates are arranged, heating the sealing layer and the frame body to melt or soften the sealing layer, and at the same time, discharging gas from the frame body; and after the gas is discharged, moving the front substrate and the back substrate in a direction that the substrates are close to each other, thereby to press the frame body against the sealing material layer to be bonded thereto and to seal the peripheral edges of the front substrate and the back substrate, wherein the metal frame body has outwardly extending protrusions located at the peripheral portion, and the frame body is supported by the protrusions such that the frame body is spaced from the sealing material layer; and wherein the metal frame body is pressed by the protrusions to come in contact with the sealing layer and to be bonded thereto.

2. A method of manufacturing an image display device comprising an envelope having a front substrate and a back substrate, which are oppositely arranged and have image displaying pixels, and a sealing portion which seals peripheral edges of the front substrate and the back substrate, the method comprising:

forming a sealing layer entirely on and along at least one of an inner peripheral edge of the front substrate and an inner peripheral edge of the back substrate;

arranging a frame body of metal extending along an inner peripheral portion of the front substrate or the back substrate on the inner peripheral edge in a state that the frame body is spaced from the sealing layer;

after the frame body is arranged, arranging the front substrate and the back substrate in a state that the substrates are confronted with each other;

after the substrates are arranged, heating the sealing layer and the frame body to melt or soften the sealing layer, and at the same time, discharging gas from the frame body; and after the gas is discharged, moving the front substrate and the back substrate in a direction that the substrates are close to each other, thereby to press the frame body against the sealing material layer to be bonded thereto and to seal the peripheral edges of the front substrate and the back substrate, wherein the metal frame body has outwardly extending protrusions located at the peripheral portion, and the frame body is supported by the protrusions such that the frame body is spaced from the sealing material layer; and wherein the protrusions of the metal frame body each include a bent portion located at the end thereof opposite to the frame body, and the frame body is positioned by engaging the bent portion with the end of the front substrate or the back substrate.

3. A method of manufacturing an image display device comprising an envelope having a front substrate and a back substrate, which are oppositely arranged and have image displaying pixels, and a sealing portion which seals peripheral edges of the front substrate and the back substrate, the method comprising:

forming a sealing layer entirely on and along at least one of an inner peripheral edge of the front substrate and an inner peripheral edge of the back substrate;

arranging a frame body of metal extending along an inner peripheral portion of the front substrate or the back substrate on the inner peripheral edge in a state that the frame body is spaced from the sealing layer;

after the frame body is arranged, arranging the front substrate and the back substrate in a state that the substrates are confronted with each other;

after the substrates are arranged, heating the sealing layer and the frame body to melt or soften the sealing layer, and at the same time, discharging gas from the frame body; and after the gas is discharged, moving the front substrate and the back substrate in a direction that the substrates are close to each other, thereby to press the frame body against the sealing material layer to be bonded thereto and to seal the peripheral edges of the front substrate and the back substrate, wherein the metal frame body has outwardly extending protrusions located at the peripheral portion, and the frame body is spaced from the sealing layer by supporting the protrusions by supporting members; and wherein, when the metal frame body is heated, the supporting members are molten and the metal frame body drops by gravity to come into contact with the sealing layer to be bonded thereto.

* * * * *